United States Patent [19]

Stock et al.

[11] 4,008,658

[45] Feb. 22, 1977

[54] APPARATUS FOR RECEIVING AND COMPACTING WASTE MATERIAL

[75] Inventors: Arthur J. Stock, Lakewood; Donald E. Christofer, Willowick, both of Ohio

[73] Assignee: Stock Equipment Company, Cleveland, Ohio

[22] Filed: Mar. 26, 1975

[21] Appl. No.: 562,060

[52] U.S. Cl. ..... 100/53; 53/124 B; 100/91; 100/229 R; 100/269 R; 252/301.1 W; 252/301.15

[51] Int. Cl.[2] ..... B30B 1/32; B30B 15/04

[58] Field of Search ..... 141/286, 73, 80; 100/90, 91, 102, 229 A, 229 R, 53, 269 R, 215; 98/115 VM; 53/124 B; 252/301.1 W, 301.1 S

[56] References Cited

UNITED STATES PATENTS

| | | | |
|---|---|---|---|
| 312,968 | 2/1885 | Carey | 53/124 B |
| 2,607,435 | 8/1952 | Dohse | 100/90 |
| 2,641,122 | 6/1953 | Cavagnaro et al. | 100/229 R |
| 3,025,785 | 3/1962 | Deems | 100/90 |
| 3,353,478 | 11/1967 | Hopkins | 100/229 A |
| 3,377,945 | 4/1968 | Davis | 100/90 |
| 3,583,312 | 6/1971 | Van Doorn et al. | 100/90 |
| 3,636,864 | 1/1972 | Loscialo | 100/91 |
| 3,881,408 | 5/1975 | Valor | 100/53 |

*Primary Examiner*—Billy J. Wilhite
*Attorney, Agent, or Firm*—Bosworth, Sessions & McCoy

[57] ABSTRACT

Apparatus for receiving and compacting waste material such as paper, fabrics, plastics, light metal, etc., for convenient disposal and for capturing particles of dust such as radiation contaminated particles, generated during the receiving and compacting operations. The apparatus is adapted to support a removable drum in which the waste material is loaded, subsequently compacted by a vertical ram and then disposed of. A cylindrical loading chamber over the drum has access doors that are closed during the compacting operation to define when closed a confined space through which the loaded waste material is guided during the initial portion of the compacting operation. An exhaust system communicating with the loading chamber draws off surrounding atmosphere during the compacting operation and includes filters for removing particles of dust and/or other contaminates entrained in the surrounding atmosphere. Particle laden filters are disposed of in a drum.

10 Claims, 9 Drawing Figures

APPARATUS FOR RECEIVING AND COMPACTING WASTE MATERIAL

BACKGROUND OF THE INVENTION

This invention relates to waste disposal and especially to the compaction of waste material such as paper, fabrics, plastics, light metal and the like that is loaded into a suitable receptacle such as a metal drum. More particularly the invention relates to apparatus for compacting of such wastes into receptacles, while preventing the dispersal into the atmosphere surrounding the apparatus, of particles that are dangerous, or undesirable, that may be released from the waste during the compaction process.

Although useful for other purposes, the invention provides special advantages and has particular utility in connection with the disposal of wastes contaminated with radioactive particles which may tend to become dislodges and susceptible to movement during the compacting process. Such waste is often generated in operation of nuclear power generating stations. Accordingly, the invention will be described below in connection with the compaction of waste in such circumstances.

In nuclear power generating stations extreme precautionary measures must be taken to protect workers and others from the harmful effects of radioactivity. For example, workers must be protected from radioactive dust particles dispersed or entrained in the surrounding atmosphere.

In the disposal of various waste material that is essentially non-radiation emitting, such as paper, fabric material, plastics and light metal, conventional public waste disposal systems cannot be used both for psychological reasons and for the reason that radioactive matter could inadvertently be included. Accordingly, it is most convenient to compact such wastes into suitable containers such as steel drums and dispose of the filled drums in accordance with known procedures for disposing of radioactive waste materials.

In the compaction operation, however, considerble dust is often generated due to the breakage and compression of the waste material resulting from the forces exerted by mechanisms used to accomplish the compacting. This dust is hazardous as it may include radioactive particles. Waste compacting mechanisms available in the prior art are unacceptable for the reason that they permit dispersion of radioactive particles that can create a harmful atmosphere around the compacting apparatus for the reasons discussed above.

The apparatus of the present invention, however, avoids the dangers described above and affords other features and advantages heretofore not obtainable.

SUMMARY OF THE INVENTION

It is an object of the invention to safely receive and compact waste material including dust particles and the like that could otherwise become entrained in the surrounding atmosphere during the compaction procedure.

It is another object of the invention to safely compact waste material without releasing harmful dust in the vicinity of the compacting mechanism.

Another object of the invention is to capture dust particles that might become dispersed in the atmosphere within a waste compacting mechanism.

These and other objects and advantages are accomplished by the apparatus of the present invention which is adapted to receive and compact waste material as well as to capture particles generated during the receiving and compacting operation and that might otherwise become dispersed in the atmosphere surrounding the compacting apparatus. The apparatus includes a main body for receiving and supporting a cylindrical waste receptacle or drum and which defines a loading chamber above the receptacle. The loading chamber also serves as a means for guiding material being compacted downwardly into the receptacle and preventing its escape to the sides above the upper end of the receptacle.

The apparatus includes doors operatively connected to the main body to define the cylindrical loading chamber and which are movable between an open position permitting access to the chamber for loading waste and a closed position to enclose the chamber for the reasons described above. A power ram that is reciprocable in the loading chamber and in the receptacle is used to compress and thus compact the waste material deposited in the drum and the loading chamber. Special provision is made for expelling atmosphere from the loading chamber and receptacle and for introducing replacement atmosphere therein during the compacting operation. Also means may be provided for filtering from the atmosphere being expelled, particles that become entrained therein as a result of the compacting operation.

DESCRIPTION OF THE PREFERRED EMBODIMENT

Referring more particularly to the drawings there is shown an apparatus A embodying the invention and adpated to receive and compact waste material such as paper, fabrics, plastics, light metal, etc. for convenient disposal and also for capturing harmful particles that are generated during the compacting process and that otherwise could be dispersed in the atmosphere surrounding the apparatus. While not limited specifically to a particular application, the apparatus shown has been specially designed for use in connection with the disposal of waste material at nuclear power generating stations where the problem of radioactive dust collection is particularly important.

The apparatus A is adapted to receive and compact waste material in an open-topped substantially cylindrical 55 gallon drum D of known dimensions; the top of which may be closed with a lid in known manner.

Figure 1:
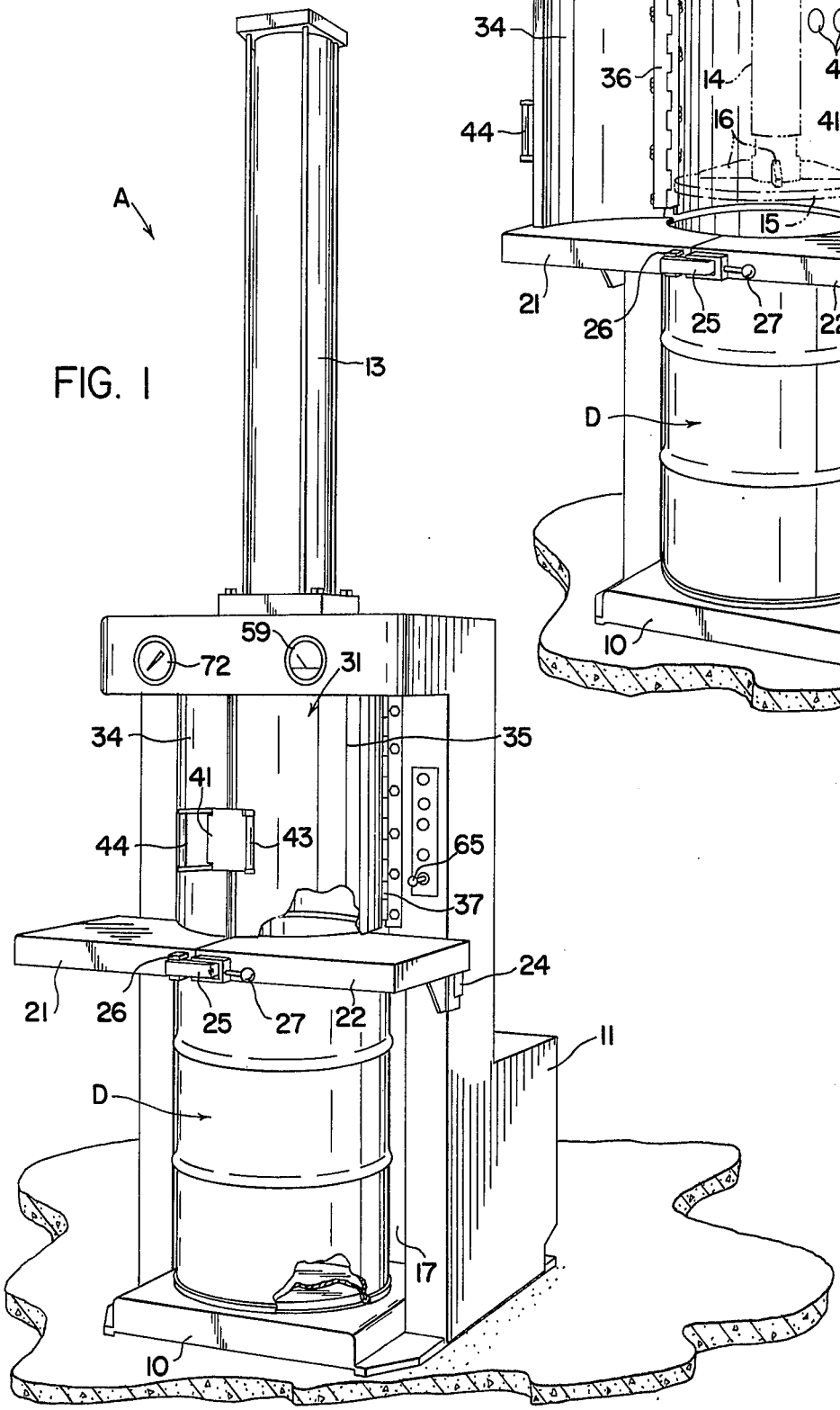
FIG. 1 is a perspective view with parts broken away illustrating a waste receiving and compacting apparatus embodying the invention, the doors to the loading chamber being illustrated in the closed position.
Figure 4:
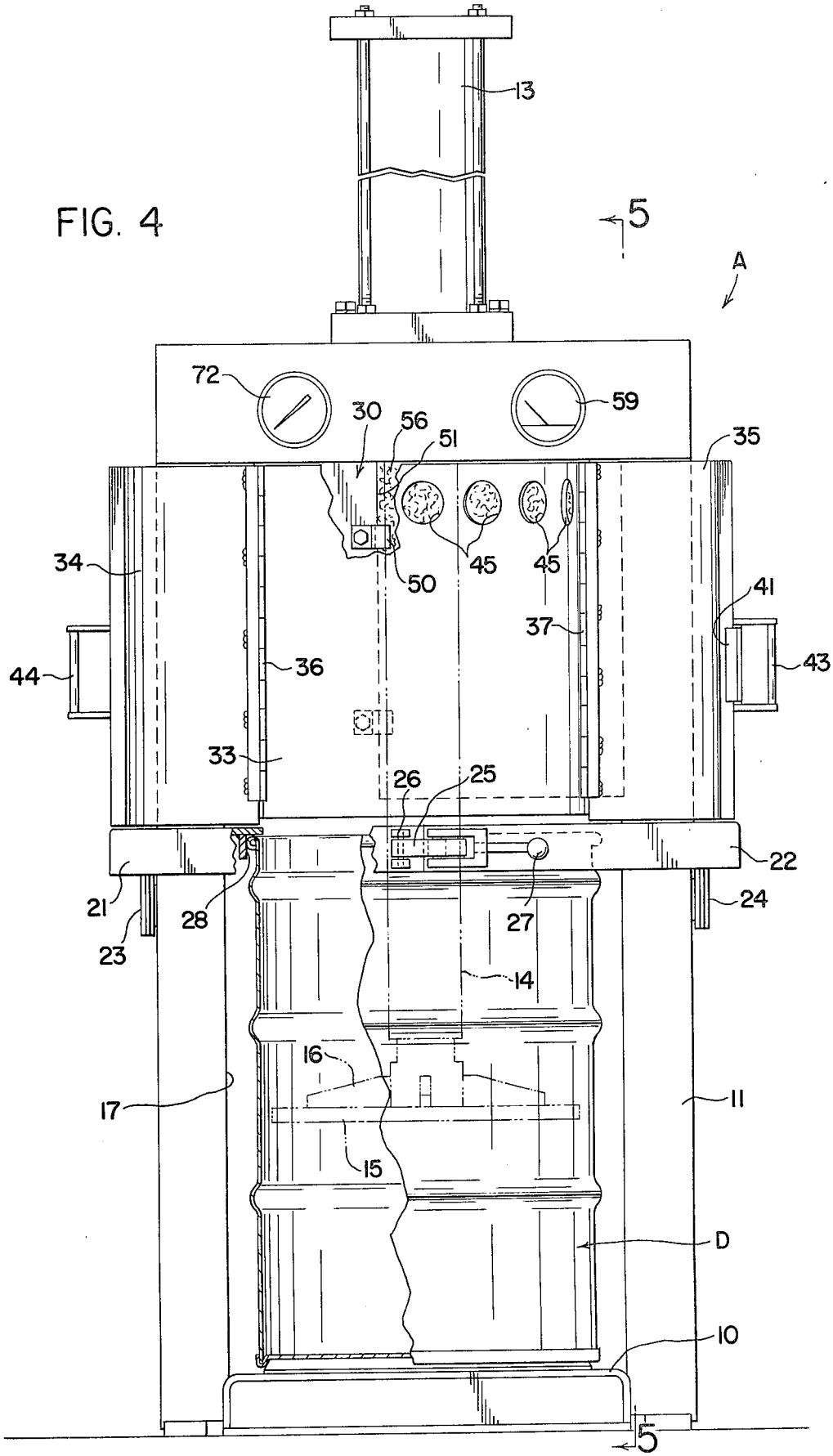
FIG. 4 is a front elevation of the apparatus of FIGS. 1, 2 and 3 with the loading chamber doors open, and parts broken away and shown in section for the purpose of illustration.
Figure 5:
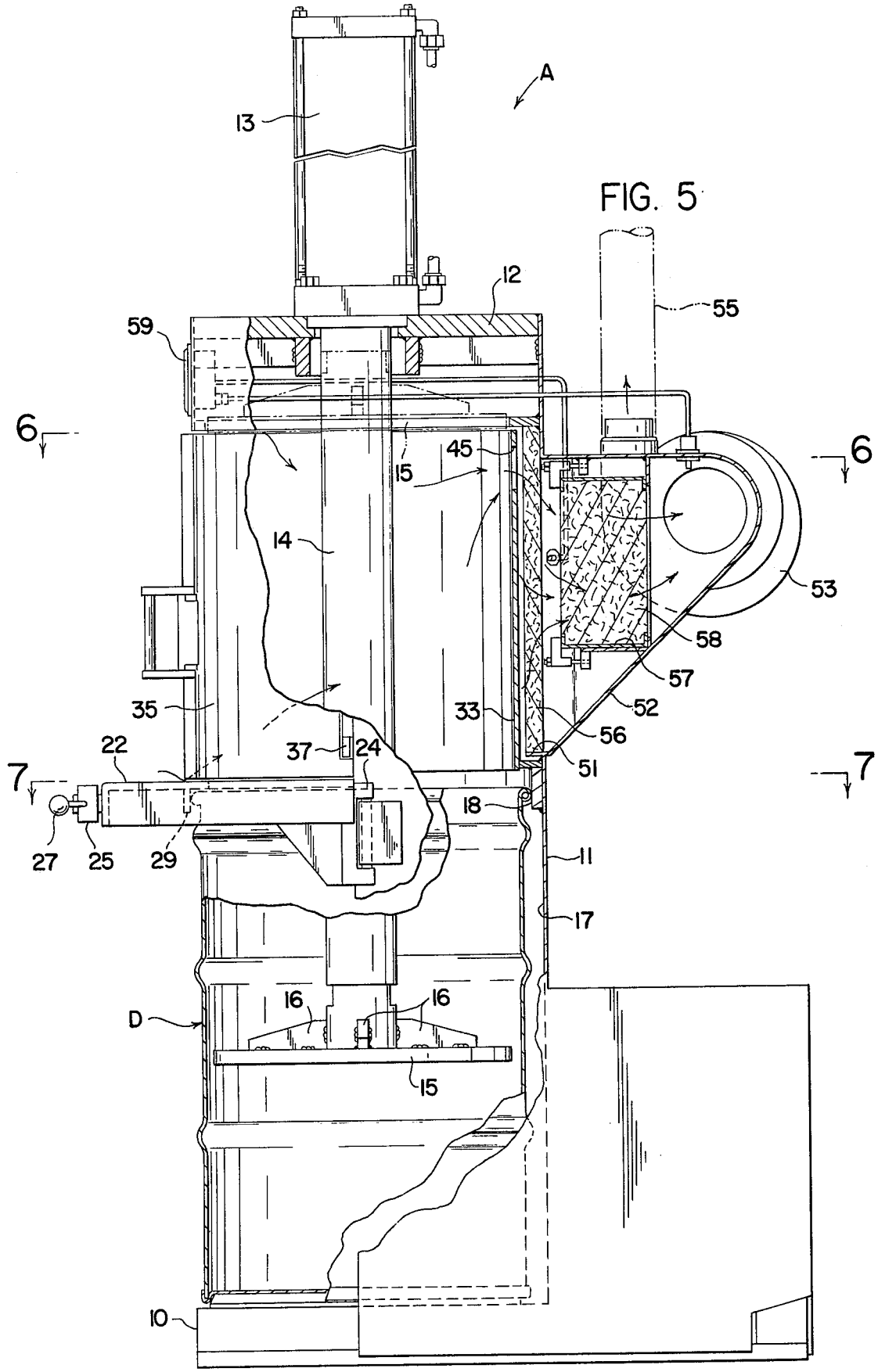
FIG. 5 is a sectional view taken on the line 5—5 of FIG. 4 with the loading chamber doors open, and parts broken away for the purpose of illustration.

The apparatus A has a base plate 10 contoured to fit the bottom of the drum D (FIGS. 1, 4 and 5) and to support essentially the entire area of the bottom surface of the drum so as to distribute compacting pressure over as large an area of the drum bottom as possible. The apparatus A has an upright body 11 formed of heavy steel sheet welded to provide the desired rigid structure. The body 11 has a top plate 12 which supports a fluid-operated 8 inch diameter power cylinder 13. The fluid cylinder 13 drives a 5 inch diameter piston rod or ram 14 through a vertical reciprocating path of travel. A compactor plate 15 is rigidly connected to the lower end of the piston rod 14 by four steel brackets 16 welded as shown. The dimensions of the circular compactor plate 15 are closely matched to the interior cross section of the drum D so that all or substantially all of the waste material in the drum is uniformly compacted as illustrated in FIGS. 4 and 5.

The drum D is received in its upright position, with its open end at its top, on the base plate 10 within an upwardly extending recess 17 defined by the lower portion of the body 11. The upper rim of the drum D is located closely adjacent a rim 18 (FIGS. 5 and 7) in the body 11. From FIGS. 3 and 7 it will be noted that during the receiving and removing of drums D, a pair of loading table sections 21 and 22 must be moved to an open position. Hinges 23 and 24 (FIG. 6) between body 11 and sections 21 and 22 permit the sections to be moved between a closed position illustrated in FIGS. 1 and 2 and an open position illustrated in FIGS. 3 and 7.

In the closed position the sections 21 and 22 are secured together by a latch 25 on the section 22 that engages a catch 26 on the section 21. The latch 25 is moved into and out of latching engagement with the catch 26 by a latch handle 27. The sections 21 and 22 have a rim portion 28 and 29 each of which extends about 90° of arc and is closely adjacent to and may engage the rim of the drum D.

In the space above the drum D the body 11 defines a loading chamber 30. Within the loading chamber 30 is a cylindrical enclosure 31 having an inner diameter closely corresponding to the inner diameter of the drum D. Enclosure 31 serves as a guide for waste material to be compacted that is piled above the level of the drum within the enclosure so that during the compacting movement of the piston 14 and compactor plate 15 the material is guided downwardly into the drum D. The cylindrical enclosure 31 is pivotable between the operating position illustrated in FIGS. 1, 4 and 5, and a partially removed position best illustrated in dashed lines in FIG. 6, the enclosure being pivotally connected to the body 11 by a hinge 32. The necessity for removing the cylindrical enclosure 31 will be apparent from the discussion below of the filtering system.

The enclosure 31 includes a back wall 33 of semicylindrical form and left and right safety doors 34 and 35 extending about 90° of arc and when secured together completing the cylindrical shape. The safety doors 34 and 35 are pivotally connected to the back wall 33 at hinges 36 and 37 respectively. The doors are illustrated in their open positions in FIGS. 2, 3, 4, 5 and 6 and in their closed position in FIG. 1. In the closed position the doors 34 and 35 are secured by a latch 41 on the door 35 that engages the catch 42 on the door 34. The latch 41 is pivoted between its latched and unlatched positions by a handle 43. The door 34 has a fixed handle 44. As a safety measure, the ram 14 may not be operated unless both the safety doors 34 and 35 are closed. Furthermore, movement of the ram will stop when either of the doors 34 and 35 are opened.

Figure 6:
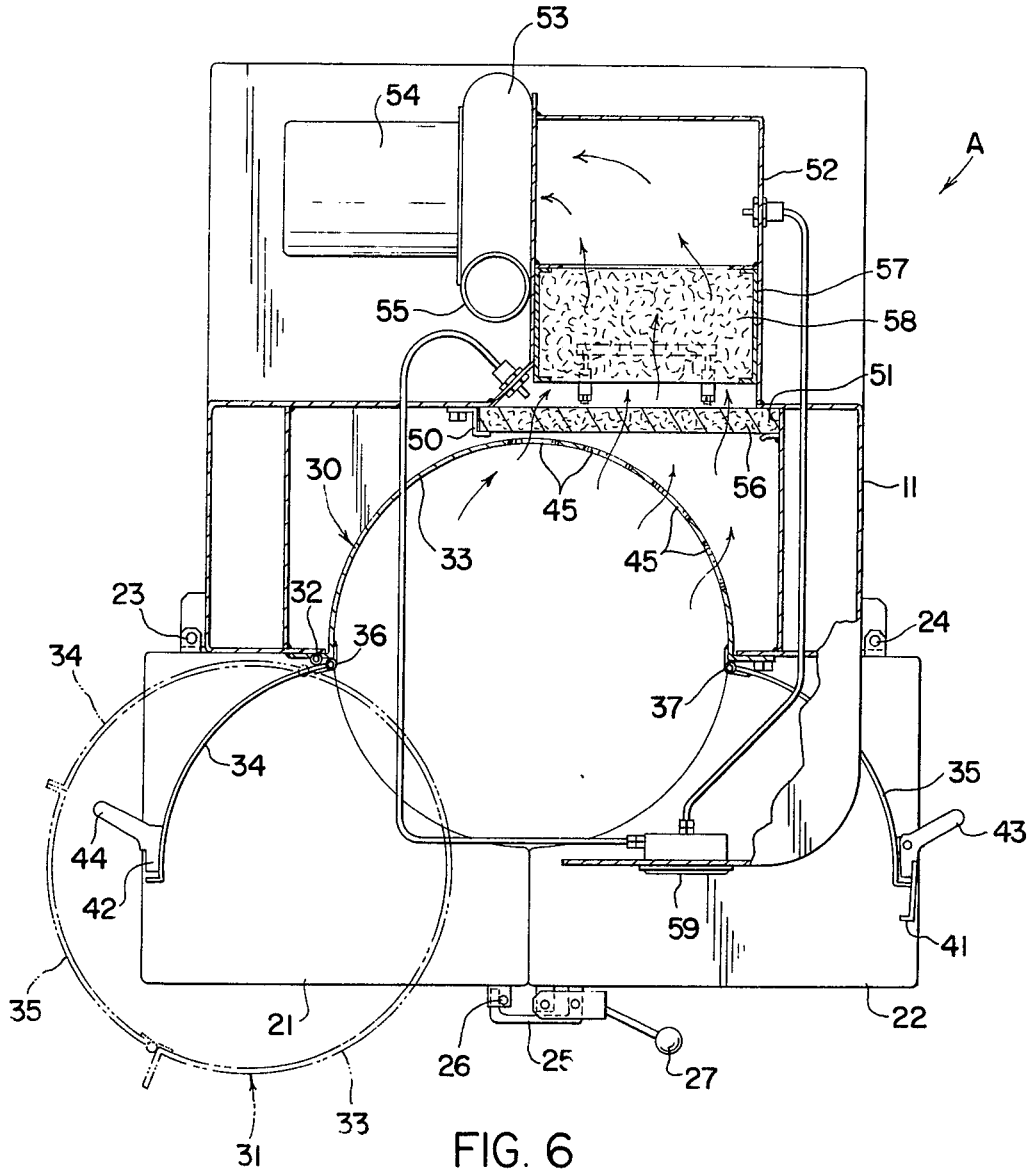
FIG. 6 is a sectional view taken on the line 6—6 of FIG. 5 illustrating the loading chamber doors in the open position in solid lines and illustrating the entire loading chamber assembly in the removed position in dashed lines to provide access to the particle filters.
Figure 7:
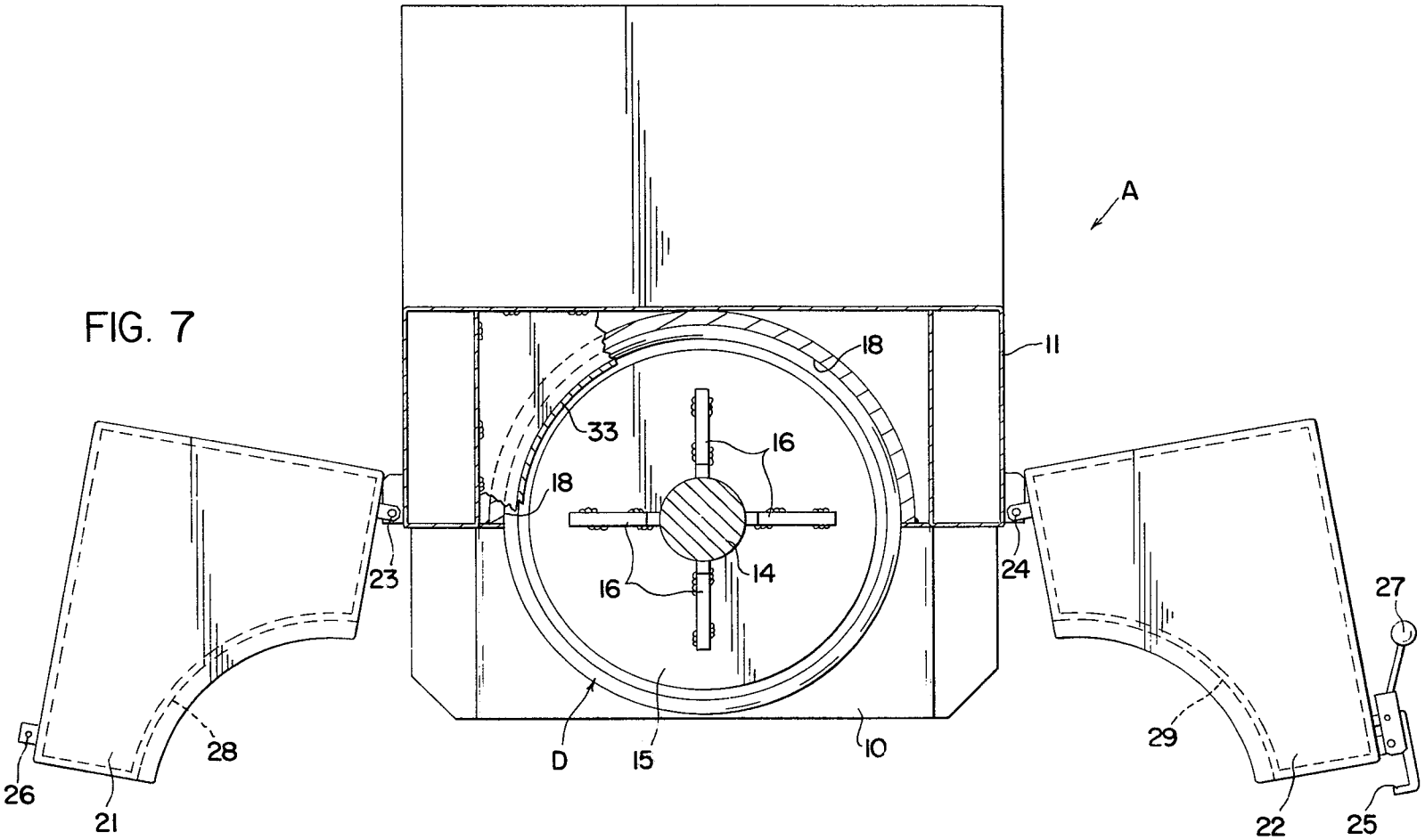
FIG. 7 is a sectional view taken on the line 7—7 of FIG. 5 with parts broken away and shown in section for the purpose of illustration and showing the loading table sections pivoted outward to the open position to permit removal of the disposal drum.

The back wall 33 has a plurality of circular ports 45 therethrough which communicate from the interior of cylindrical enclosure 31 to the other portions of the loading chamber 30 to permit the evacuation of the atmosphere within the drum D and the enclosure 31. The rear wall of the loading chamber 30 has a rectangular opening 51 which communicates to an exhaust duct 52 (FIGS. 5 and 6). Located in the duct 52 is a centrifical blower 53 driven by a motor 54. The blower 53 exhausts atmosphere through a vertical outlet stack 55.

Located within the opening 51 is a rectangular roughing filter 56 having dimensions of approximately 16 × 20 inches and formed, for example, of monacrylic fiber. The nominal capacity of the filter 56 is 670 CFM (cubic feet per minute) of air.

Located within the exhaust duct 52 immediately behind the filter 56 is a rectangular frame 57 adapted to support a higher efficiency filter 58 having dimensions of approximately 12 × 12 inches and formed, for example, of glass fibers. It has a nominal capacity of 150 CFM and is adapted to capture smaller size particles that pass through the roughing filter 56. The exhaust blower motor 54 is a 1 HP, 3400 RPM, 3 phase electrical motor having a capacity of 600 CFM at 3 in. Hg. static pressure.

During the compacting operation the atmosphere in the cylindrical enclosure 31, which may contain entrained particles generated by the breaking or collapsing of waste material during the compacting operation, is evacuated through the ports 45, into the loading chamber 30 is and replaced by that which is drawn in around the sides of the drum 8. The particle-laden atmosphere being exhausted is drawn from the loading chamber 30 through the roughing filter 56 and into the duct 52. The material in the duct 52 passes through one or more higher efficiency filters 58 which completely or essentially remove all of the entrained particles, after which the clean atmosphere is exhausted through the stack 55.

When the filters 56 and 58 are loaded and need to be replaced the cylindrical enclosure 31 is pivoted out of the loading chamber 30 about the hinge 32 to the position illustrated in phantom lines in FIG. 6. This affords access first to the roughing filter 56 in the rectangular opening 51, whereby the filter 56 may be removed with appropriate tools and dropped into the drum D for disposal, and then to the higher efficiency filter 58 which may also be removed with appropriate tools and dropped into the drum D. Replacement filters may then be installed after which the cylindrical enclosure 31 is returned to its operating position best shown in FIG. 1.

FLUID OPERATING SYSTEM

Figure 8:
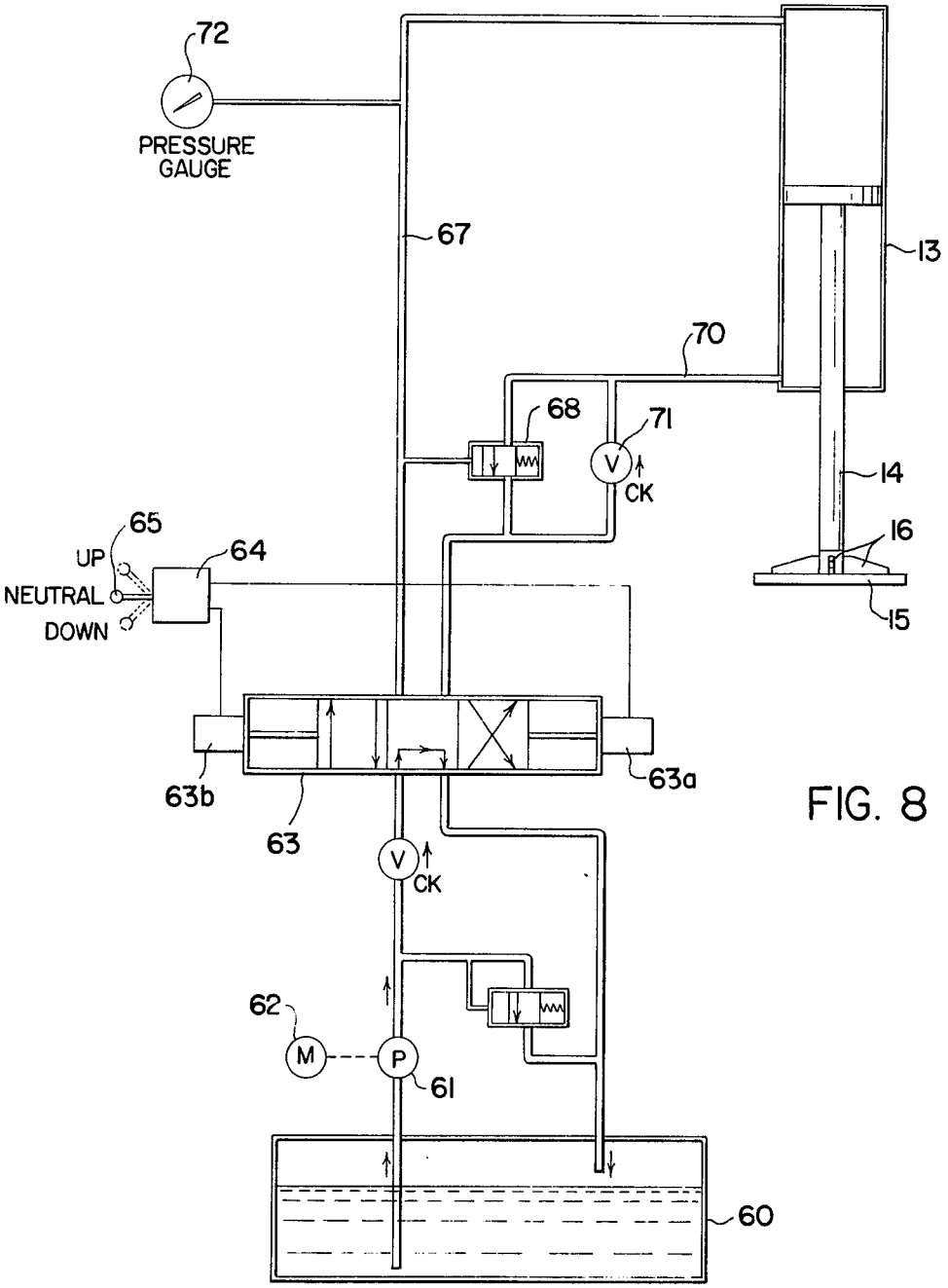
FIG. 8 is a schematic diagram of the hydraulic system for operating the compacting ram of the apparatus.

FIG. 8 illustrates the fluid operating system for the fluid cylinder 13. The system includes a fluid resevoir 60 from which fluid is pumped by a pump 61 driven by a motor 62, and a manually adjustable pressure regulator valve 66.

A four way solenoid valve 63 is controlled by a switching unit 64 connected to solenoids 63a and 63b, with an operating handle 65 movable between "up", "neutral" and "down" positions. FIG. 8 illustrates the neutral position of the valve whereat fluid delivered to the valve by the pump 61 is merely returned to the resevoir 60. When the valve is moved to the right with reference to its position illustrated in FIG. 8, the fluid delivered by the pump 61 is directed by the valve 63 through a pressure line 67 to the head end of the cylinder 13. In this condition the fluid forces the plate 15 downward through a drive stroke which serves to compact material in the cylindrical enclosure 31 of drum D tightly downwardly into the drum D. A pressure regulator valve 68 prevents excessive compacting pressure.

When the handle 65 is moved to the down position the solenoid valve 63 is moved to the left from the position illustrated in FIG. 8 whereupon fluid delivered by the pump 61 is directed through a pressure line 70 having a check valve 71, to the tail end of the cylinder 13. This drives the piston and piston rod upwardly to retract the compactor plate 15, fluid in the head end of the cylinder being exhausted through the line 67 back to the resevoir 60.

In the embodiment shown the motor 62 is a 15 HP 1750 RPM, 440 volt, 60 CPS, 3 phase electric motor and the hydraulic pump 61 is a 1200 HP, 600 PSIG, vane-type unit. This system is capable of delivering a maximum compressive force of 30,000 pounds and has a maximum hydraulic system pressure of 600 psi.

ELECTRICAL SYSTEM

Figure 9:
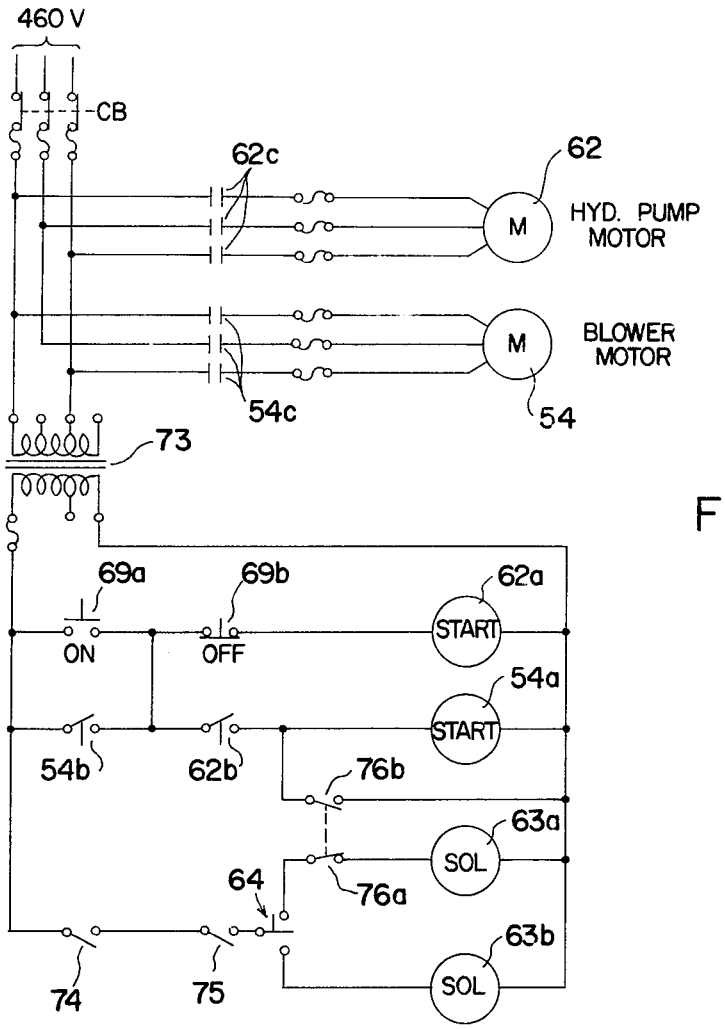
FIG. 9 is a schematic diagram of the electrical control system for the apparatus of the invention.

FIG. 9 illustrates the electrical circuitry and components for controlling the apparatus A. The hydraulic pump motor 62 and blower motor 54 are connected to a 460 volt, three phase power supply line through appropriate switching and fusing. The power supply for the various control solenoids is taken from a transformer 73.

The starting solenoids **62*a* and 54*a* for the hydraulic pump motor 62 and blower motor 54 respectively are energized through a main "push-to-start" switch 69*a* which when pushed by the operator instaneously completes the circuit to the solenoid 62*a*. Solenoid 62*a* when energized, closes switch contacts 62*b* to complete the circuit to the solenoid 54*a*. Solenoid 54*a* when energized closes holding switch contacts 54*b* to complete the circuit through both solenoids 62*a* and 54*a* and to hold them both in their energized conditions even though the spring loaded push-to-start switch 69*a* is released by the operator. When energized, the solenoids 62*a* and 54*a* close switch contacts 62*c***.

The motors 62 and 54 are deenergized by the operator by depressing normally closed switch **69*b* located in the circuit to the solenoid 62*a*. When switch 69*b* is instaneously opened, the solenoid 62*a* is deenergized and switch contacts 62*b* open to deenergize starter solenoid 54*a***.

The solenoids **63*a* and 63*b* of the fluid control valve 63 are controlled by the main control switch unit 64. When the switch is in the neutral position illustrated in FIG. 9 the ram up and ram down solenoids 63*a* and 63*b* cannot be energized. Also the ram up solenoid 63*a* cannot be energized when the limit switch contacts 76*a* are opened by the ram when in its up (retracted) position. Accordingly, the "ram up" solenoid 63*a* is deenergized automatically when the ram reaches its fully retracted position. Also, the limit switch contacts 76*b* automatically short circuit (and deenergize) the blower motor starting solenoid 54*a* when the ram reaches its up position. Consequently, switch contacts 54*b* open to deenergize the pump motor solenoid 62*a* as well. The solenoids 63*a* and 63*b* can be energized only when both safety door limit switches 74 and 75 are closed. As indicated above, these switches are closed only when the safety doors 34 and 35** are closed.

OPERATION

Figure 2:
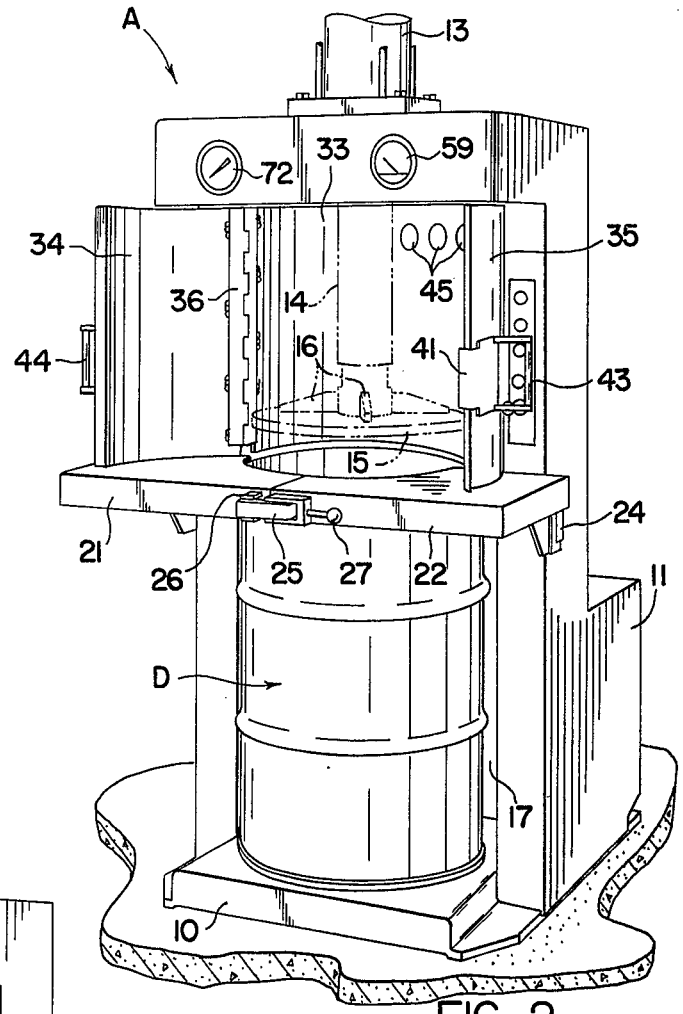
FIG. 2 is a fragmentary perspective view similar to FIG. 1 illustrating the doors to the loading chamber in their open position and showing the extended position of the compacting ram in dashed lines.
Figure 3:
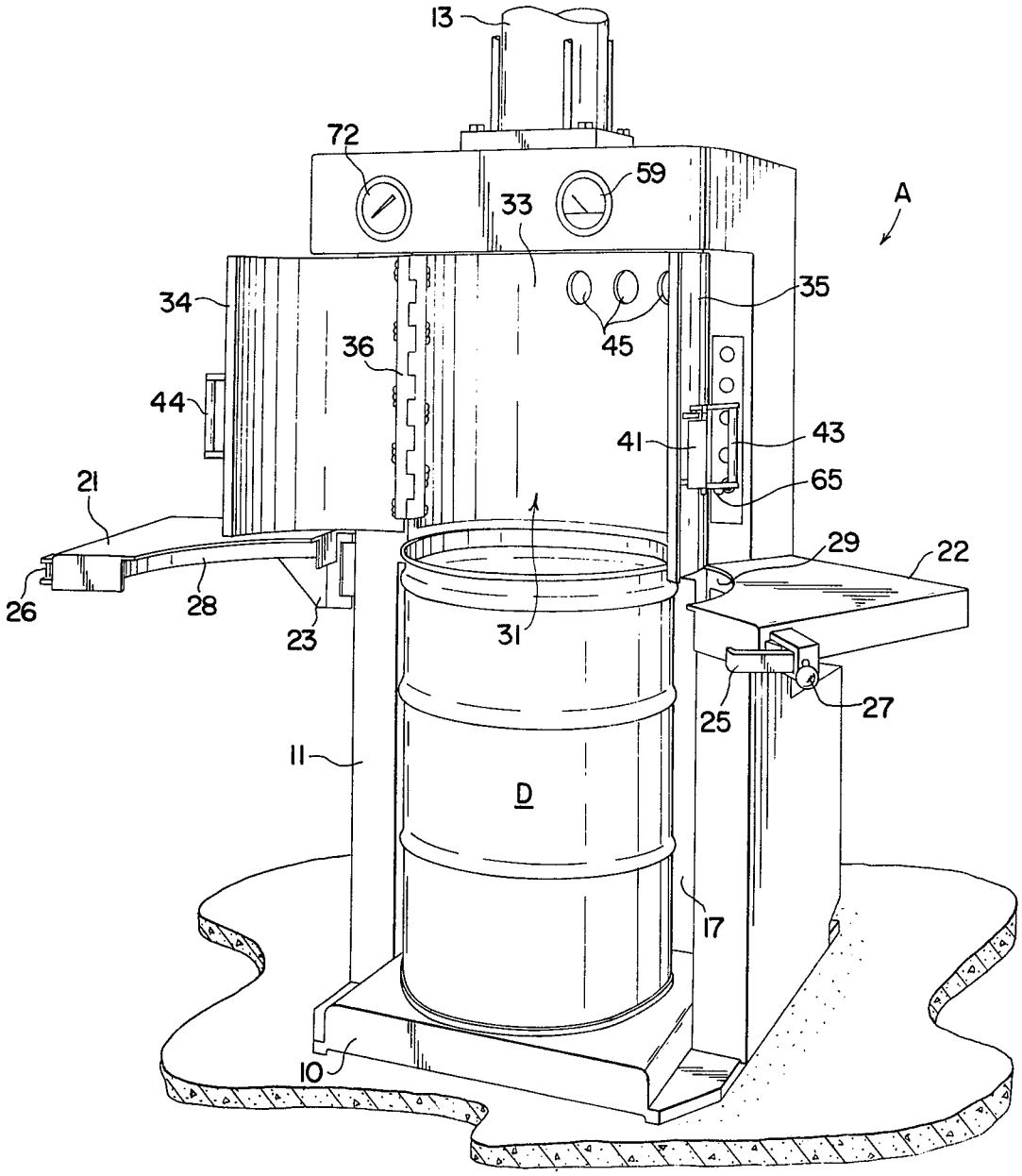
FIG. 3 is an enlarged fragmentary perspective view of the waste receiving and compacting apparatus of FIGS. 1 and 2 illustrating the loading chamber doors and the pivotable loading table sections in their open position.

In a typical operation of the apparatus A the compactor plate 15 is first moved to its upright position, and the control handle 65 is in its neutral position. A suitable steel drum D is initially positioned on the base plate 10 by opening both the safety doors 34 and 35 and the loading table sections 21 and 22 as illustrated in FIG. 3. The drum D is positioned with its bottom on the contoured portion of the base 10. Then the loading table sections 21 and 22 are closed and latched as illustrated in FIG. 2. When initially positioned, the drum D may be either empty or partially filled with uncompacted waste material. Additional waste material is loaded into the drum through the loading chamber 30 with safety doors 34 and 35 in the open position. The waste material may be piled above the top of the drum in the cylindrical enclosure 31 as desired.

When sufficient waste material has been loaded in the drum D and the cylindrical enclosure 31, an operator closes and latches the safety doors 34 and 35 to close the limit switches 74 and 75, pushes the start buttom **69*a* and pulls the control handle 65 (FIG. 8) to the down position. This operates the solenoid valve 63 (the pump motor 62 having already been energized) so that the pump 61 delivers fluid from the resevoir through the valve 63 and pressure line to the head end of the cylinder 13. Thus the cylinder 14 is driven downward with the compactor plate 15** to compact waste material in the drum.

Once the extension of the rod 14 was halted, the operator moves the control handle to the up position to shift the solenoid valve 63 and direct fluid pressure through the return line 70 and thus cause retraction of the piston rod 14 and compactor plate 15 to permit insertion of additional waste material into the drum and loading chamber, and the compacting operation repeated. After enough compacting operations have been performed to substantially fill the drum D with compacted material, the loading table sections are opened and the filled drum removed and its cover (not shown) installed on the open end of the drum in a known manner. The drum is then ready for appropriate disposal.

While the invention has been shown and described with reference to a specific embodiment thereof this is intended for the purpose of illustration rather than limitation and other variations and modifications of the specific device herein shown and described will be apparent to those skilled in the art all within the intended spirit and scope of the invention. Accordingly, the patent is not to be limited to the specific embodiment herein shown and described nor in any other way that is inconsistent with the extent to which the progress and the art has been advanced by the invention.

We claim:

1. Apparatus for receiving and compacting waste material and for capturing particles generated during the receiving and compacting operations and subject to being dispersed in the surrounding atmosphere, comprising:

a main body for receiving and supporting a waste receptacle, and defining a loading chamber above said receptacle, means defining an enclosure movable between an operating position within said loading chamber and a retracted position outside of said loading chamber to afford access to the interior of said loading chamber, a power ram having a compacting portion reciprocable in said loading chamber and in said receptacle between a retracted position outside of said loading chamber and an extended position inside of said receptacle, for compacting material in said receptacle, and means for expelling atmosphere from said loading chamber and receptacle and from said enclosure when it is within said loading chamber and for introducing clean replacement atmosphere to remove particles dispersed in the atmosphere in said receptacle, loading chamber and enclosure during the compacting operation.

2. Apparatus as defined in claim 1 including means for filtering said atmosphere being expelled to remove said dispersed particles therefrom before said atmosphere is discharged from said apparatus.

3. Apparatus as defined in claim 1 wherein said enclosure is pivotable between an operating position within said loading chamber and a retracted position outside of said loading chamber to afford access to the interior of said loading chamber.

4. Apparatus as defined in claim 1 including a pair of safety doors integral with said enclosure to permit when open access for loading waste material into said receptacle and said enclosure.

5. Apparatus as defined in claim 1 including means defining an exhaust opening in the wall of said chamber communicating with said exhausting means, and a filter element removably received in said exhaust opening.

6. Apparatus as defined in claim 5 including at least one other filter element associated with said exhausting means.

7. Apparatus as defined in claim 1 including means for supporting said receptacle in a fixed compacting position, said means including a base portion in said main body contoured to correspond to the bottom of said waste receptacle and to engage and support at least a substantial portion of the area of said bottom.

8. Apparatus as defined in claim 1 wherein said receptacle is cylindrical.

9. Apparatus as defined in claim 8 wherein said receptacle is located in an upright position and said power ram has a vertical path of reciprocating travel.

10. Apparatus for receiving and compacting waste material and for capturing particles generated during the receiving and compacting operations and subject to being dispersed in the surrounding atmosphere comprising:

a main body for receiving and supporting a cylindrical waste receptacle and defining a loading chamber above said receptacle, means defining a cylindrical enclosure within said loading chamber, said enclosure means having a circular cross section closely corresponding to the cross section of the interior of said waste receptacle and being pivotable between an operating position within said loading chamber and a retracted position outside of said loading chamber, door means integral with said enclosure means to permit when open, access for loading waste material into said receptacle and said enclosure means, means for supporting said receptacle in a fixed compacting position, said means including a base portion in said main body contoured to correspond to the bottom of said waste receptacle and to engage and support at least a substantial portion of the area of said bottom, a power ram having a compacting portion reciprocable in said enclosure means and in said receptacle between a retracted position outside of said enclosure means and an extended position inside of said receptacle, for compacting material in said receptacle, means for expelling atmosphere from said loading chamber and receptacle and introducing replacement atmosphere to remove particles dispersed therein during the compacting operation, means defining an exhaust opening in the wall of said loading chamber communicating with said exhausting means, and filter means removably received in said exhaust opening.

* * * * *